United States Patent [19]

Jondro et al.

[11] Patent Number: 4,842,146

[45] Date of Patent: Jun. 27, 1989

[54] PULSATOR FOR ENRICHING, PARTICULARLY HARD COAL

[75] Inventors: Boleslaw Jondro, Zabrze; Jan Janik, Gliwice; Herbert Pyka, Ruda, all of Poland

[73] Assignee: Zabrzanskie Gwarectwo Weglowe Kopalnia Wegla Kamiennego "Zabrze-Bielszowice" , Poland

[21] Appl. No.: 142,262

[22] Filed: Jan. 11, 1988

Related U.S. Application Data

[63] Continuation of Ser. No. 863,037, May 14, 1986, abandoned.

[30] Foreign Application Priority Data

Nov. 6, 1984 [PL] Poland ..... 250329
Nov. 6, 1984 [PL] Poland ..... 250330

[51] Int. Cl.[4] ..... B03B 5/12; B03B 5/24

[52] U.S. Cl. ..... 209/455; 209/457; 209/488; 209/492; 209/500; 209/503

[58] Field of Search ..... 209/422, 425–427, 209/455–457, 463, 464, 488, 490, 492, 494, 500, 503, 508

[56] References Cited

U.S. PATENT DOCUMENTS

| | | | |
|---|---|---|---|
| 653,357 | 7/1900 | Montgomery | 209/455 |
| 1,352,727 | 9/1920 | Delamater | 209/457 |
| 1,448,668 | 3/1923 | Lewellen et al. | 209/457 |
| 2,132,375 | 10/1938 | Bird et al. | 209/457 |
| 2,269,686 | 1/1942 | Prickett et al. | 209/457 |
| 2,573,503 | 10/1951 | Smith | 209/455 |
| 2,740,526 | 4/1956 | Spiller | 209/490 X |
| 3,019,900 | 2/1962 | Lagrost | 209/490 X |
| 3,411,627 | 11/1968 | Garland | 209/492 X |

FOREIGN PATENT DOCUMENTS

| | | | |
|---|---|---|---|
| 0214116 | 8/1957 | Australia | 209/455 |
| 0528920 | 11/1921 | France | 209/492 |
| 0548118 | 1/1923 | France | 209/492 |

*Primary Examiner*—Robert B. Reeves
*Assistant Examiner*—Edward M. Wacyra

[57] ABSTRACT

A pulsator for enriching, particularly, hard coal has mounted in a pulsating compartment a hoisting wheel and a bracket both mounted on a drive shaft, or a ratchet wheel mounted on a drive shaft which runs in bearings above the liquid level of a working trough. The pulsating compartment is of cylindrical shape and is connected to working trough along its longer side and separated from the working trough with a wall. The pulsating compartment consists of an outer wall to which is welded a bottom wall shaped as an arc and connected via a vertical wall to an oblique wall of the working trough. The bottom wall is provided at its lowest point with a grate encased with a pulp outlet stub pipe. The hoisting wheel consists of a side wall connected with an outer screen which is connected in turn to an outer ring along the periphery of the outer screen. Inside of the hoisting wheel a perforated crown is installed at an acute angle and connected from the top above the side wall of the pulsating compartment to a discharge chute in the form of a trough provided with a bottom plate. Paddle buckets are mounted on the perforated crown. A displacer is secured inside of the hoisting wheel on a hub keyed on the drive shaft consisting of two plungers, of the shape of a closed hourglass in the vertical section and made up from two side plates connected with an outer circumferential plate.

18 Claims, 6 Drawing Sheets

PULSATOR FOR ENRICHING, PARTICULARLY HARD COAL

Figure 1:
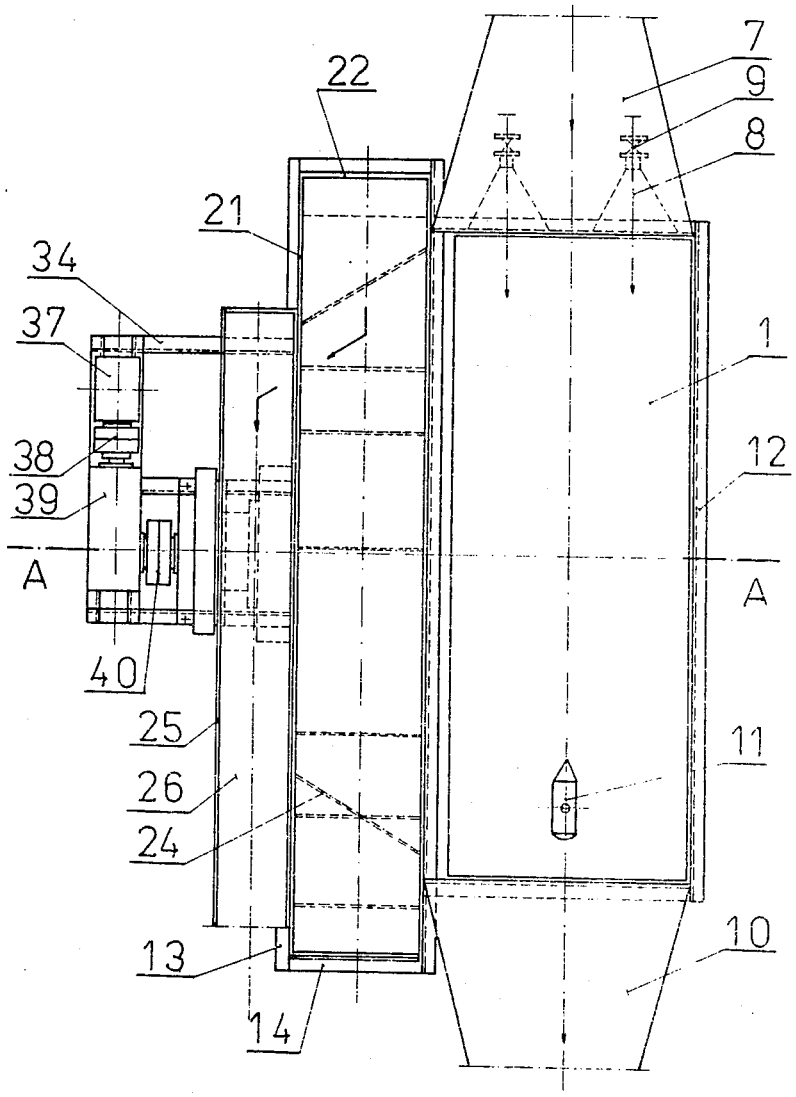

This application is a continuation of application Ser. No. 863,037, filed May 14, 1986, now abandoned.

The subject of this present invention is a pulsater for enriching, particularly hard coal, with the mechanical generation of pulsation in a fluid. The means commonly used for enriching/separating/ a mixture of mineral grains in an aqueous medium is a pulsator. The latter is a hydraulic machine wherein a mixture of grains having different specific gravities is subjected to the pulsing action of water or another liquid. Liquid pulsation in a working trough causes the grains being enriched to be separated into grain layers according to specific gravity, which enables coal concentrate, stones or overgrowth to be separated.

The liquid, being the pulsating medium, is passed through the screen bottom of the working trough which is used as a working compartment for passing the enriched mineral for separating the grains into layers according to specific gravity. For generating pulsation use was made in the earliar longitudinal pulsator designs in pulsation compartment/excidation chambers/ of eccentrically driven pistons and, presently, of high-output air compressors and rotary or slide valves which pass compressed air to an air chamber above the liquid level in the pulsating compartment, causing the liquid to rise in the working trough due to air pressure and, thus, pulsation.

The number of pulsation cycles and the magnitude of the liquid stroke are regulated by an electrical or hydraulic drive mounted for this specific purpose and driving the rotary or slide valves which supply and drain compressed air from the compressor to the pulsator.

The heavy products sinking in a liquid and passing to under the screen deck in the working trough are received by means of water-separating bucket elevators.

The pulsators in use at present differ in their design by the direction of removing the enrichment product, being divided into transversal, longitudinal and round pulsators and by the method of initiating the relative motion of grains in the liquid medium of the pulsator, the screen being stationary or movable, or by the method of receiving the sinking product from the pulsators and of removing water.

The sinking products are received in the overwhelming majority of the designs by means of water-separating bucket elevators which, as results from operating practice, are heavy units of low availability in operation and requiring high-power electrical motors for driving purposes.

The disadvantage of the known pulsators with the mechanical generation of pulses in liquid medium is the difficulty of their rapid adaptation to enrichment depending on varying parameters, for example those of hard coal, which causes coal to waste and, thus, to be lost. The pneumatic pulsators being now in use are also the machines comprising heavy assemblies with complicated regulation during operation, requiring great space in processing buildings and consuming much electric power under operation.

The means used for enriching particulate minerals, known from Polish Patent Specification No. 84,256 and comprising a mechanical device for generating pulsation in the pulsating medium, has the form of a singlecompartment enricher whose top part is cylindrical and bottom part is conical and provided with a mixer, a chute and a screen. Such a means has a rotating system of shielding wings attached to the top part of a vertical shaft, the rotating system having a ring secured with its arms to the shaft, said ring mounting shielding wings secured to it by means of bracket arms, the shielding wings being developed in a horizontal projection into a triangle having two rounded sides, one of the latter adjoining the cylindrical part of the enricher and having the same arc radius and the other being tangent to the ring and secured to it with a bracket arm.

The shielding wings, which are four for example, have the form of a mouldboard in the vertical projection, the upper edge of the mouldboard reaching that of the cylindrical part of the enricher and, also, a bend of the shielding wing enabling concentrate grains to flow over the edge to the drain trough and, next, to a screen discharge.

The enrichment of particulate minerals involves in that means subjecting the grains of a material comprised in the upper part of the enricher, by means of a rotating system of shielding wings, to the action of a rotating pulsation field generated by successive decreases in the velocity of flow of a rising liquid stream, the concentrate grains, i.e. a lighter fraction, being deflected by the mouldboard beyond an edge of the enricher to a drain trough.

Waste, being heavier, is discharged to the conical part of the enricher.

The advantage of the known means for enriching particulate materials is its small overall dimensions. However, its fundamental disadvantage is the inaccurate separation of hard coal from stones and overgrowth, caused by the insufficient separation of the material handled due to a relatively small pulsation amplitude and a difficult reception of the concentrate, particularly of high granulation. In addition, considerable difficulty was experienced in industrial practice with the continuous removal of the sinking product during the enrichment of particulate materials.

The aim of this present invention has been to eliminate, or at least to decrease, the disadvantages of the known devices for enriching in liquid medium, particularly pulsators for enriching hard coal. In order that such an aim might be achieved, it was decided to develop the design of a pulsator with mechanical pulsation generation in liquid, intended for enriching hard coal in particular and enabling the operating cost of the enricher to be lowered with the simultaneous increased recovery of/particularly, hard coal from the material being enriched, and its ash content decreased.

The design for eliminating the above-mentioned disadvantages has been developed as per this present invention in a manner such that the pulsator chamber mounts a hoisting wheel and a bracket mounted on a drive shaft running in bearings above the liquid level of the working trough.

The chamber of the hoisting wheel is cylindrical in shape and connected to the working trough at its longer side and separated with a wall from it. It consists of an outer wall to which is welded a bottom wall having an arcuate shape and connected at the other side via a vertical wall to a skew wall of the working trough, the bottom wall being provided at its lowest point with a grate enclosed in a pulp outlet stub pipe and connected to a drain pipe. The lower part of the outer wall of the chamber mounts a bottom water drain stub pipe, a valve being mounted upstream thereof.

The hoisting wheel consists of a side wall connected with an external enclosure connected in turn to an outer wing, the hoisting wheel mounting inside a perforated crown at an acute angle at the top above the side wall of the chamber connected to a discharge chute in the form of a trough provided with a bottom plate, whereas the perforated crown mounts paddle buckets.

Inside the hoisting wheel on a hub keyed to a drive shaft there is mounted a bracket consisting of two plungers, having the shape of a closed hourglass in its vertical section and made up of two side plates connected with an external circumferential plate, cover plates being added or subtracted to or from the upper and lower part of the circumferential plate. The drive of the hoisting wheel comprises an electric motor, a coupling, a transmission gear, another coupling and a planetary gearing consisting an internally toothed gear, satellite gears and a gear keyed to a drive shaft, the satellite gears being mounted on the shafts accommodated in the planetary gearing housing and the internally-toothed gear being permanently connected to a flange welded to a hub mounted on a bush secured to the drive shaft, whereas the hub is connected at the other end to a drive ring disjunctly connected to a side wall of the hoisting wheel. The drive ring is separated with a wall component of the external chamber terminating in a labyrinth seal. Between the bracket and the perforated crown of the hoisting wheel there is mounted a supporting structure connected to a support beam provided at both of its ends with pins from which suspend pendula provided at their lower part with horizontally disposed plates cooperating with the blocks limiting liquid flow upwards of the hoisting wheel. The above-mentioned aim is also satisfied by a pulsator for enriching, particularly, hard coal in a manner such, that it has mounted a hoisting wheel in the chamber and a ratched wheel on a drive shaft running in bearings above the liquid level in the chamber and working trough, the bearing housings being secured to the supporting and bearing structures. The chamber of the hoisting wheel is cylindrical in shape and connected to the working trough along its longer side and separated with a wall from the working trough.

The above-mentioned chamber of the hoisting wheel comprises an external wall to which is secured a bottom wall of arcuate shape and is connected at the other side to a vertical wall connected in its turn to an inclined wall of the working trough, the bottom wall being provided at its lowest point with a grate enclosed with a pulp outlet stub pipe connected to a drain pipe. The lower part of the external wall mounts above the pulp outlet stub pipe a bottom water supply stub pipe with a valve mounted upstream of it.

The hoisting wheel is built up from a side wall connected with an external screen which is connected at the other end to an external ring located at the side of the working trough, guide vanes being installed inside the hoisting wheel at an acute angle to the level and being connected above the side wall of the chamber to a discharge chute in the form of a trough installed along the side wall and paddle buckets being secured to the guide vanes and the side wall of the hoisting wheel.

In the upper part of the hoisting wheel under the guide vanes there is mounted a hood used for removing liquid from the sinking product from which water has been removed on the hoisting wheel, said hood being connected to a trough.

Inside the hoisting wheel there is a ratchet wheel keyed to the drive shaft and having two cam teeth at least, a frame being installed above it and a plate below it, both the frame and the plate being mounted in a telescopic housing mounted on a structure supported by a supporting structure and both being connected with end-threaded rods, and springs being mounted inside the telescope below the housing.

The frame aligned with the ratchet wheel is provided with a rotating roller whereas rubber rollers are mounted on a rod between the frame and the housing for establishing the necessary difference in liquid pulsations. The plate is provided at its sides with sealing skirts and under the ratchet wheel with a seal in the form of a rubber pad. The hoisting wheel is driven by an electric motor, a coupling, a transmission gear and a successive coupling and a planetary gearing consisting of an internally toothed gear, satellite gears and a gear keyed to a drive shaft, the satellite gears being mounted on the shafts placed inside the planetary gearing housing and the gear is permanently fixed to a hub mounted in a bush mounted in its turn on a drive shaft, the hub being connected with its other end to a drive ring of the hoisting wheel disjunctly connected to the side wall of the hoisting wheel.

The drive ring is separated with an offset part of the external wall, terminating in a labyrinth seal. The pulsator for enriching, particularly hard coal, as per this present invention eliminates from the hitherto known designs the heavy bucket elevators characterized by low availability in operation and the compressed air blowers which consume considerable amounts of electric power.

Enriching by means of the designs as per this present invention takes place with a higher liquid efficiency, a lower power consumption and, unexpectedly, a hard coal recovery increased by way of example by 2–3 per cent at least from the material being enriched and with the ash content decreased mainly due to water being drained from the sinking product.

Besides, these designs decrease the volume of the building required to house the pulsator by on the average 40 per cent with the operating cost being simultaneously lowered by about 50 per cent. The pulsator, as per this present invention and complete with a displacer, enables one drive set to be used for driving a double displacer and the hoisting wheel having different speeds which can be regulated depending on operating requirements. The varying section of the displacer along its circumference enables its shape to be adapted to the preset motion of liquid. To increase or decrease the volume of the displacer by means of cover plates enables an easy adaptation of the pulsator to the material to be handled.

The pulsator, as per this present invention and complete with a plate ratchet unit, enables the pulsation stroke to be adjusted over a wide range by changing the number of the rubber pads in the plate ratchet unit. The pressure of the plate against the liquid level can be adjusted with the number of springs depending on the requirements of the material being enriched and the area of the working trough. As a result, this enables the force of striking against the liquid to be regulated, which causes its stroke to be increased and, thus, the enrichment of particularly medium hard coal sizes to be improved.

Figure 2:
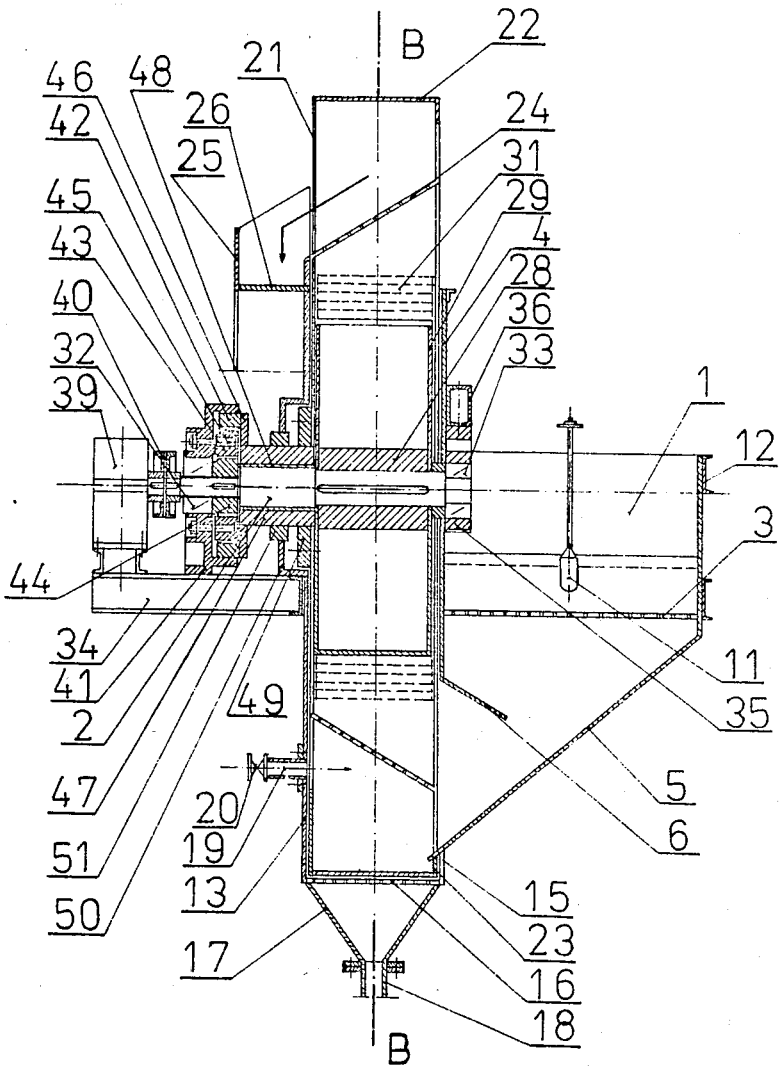
Figure 3:
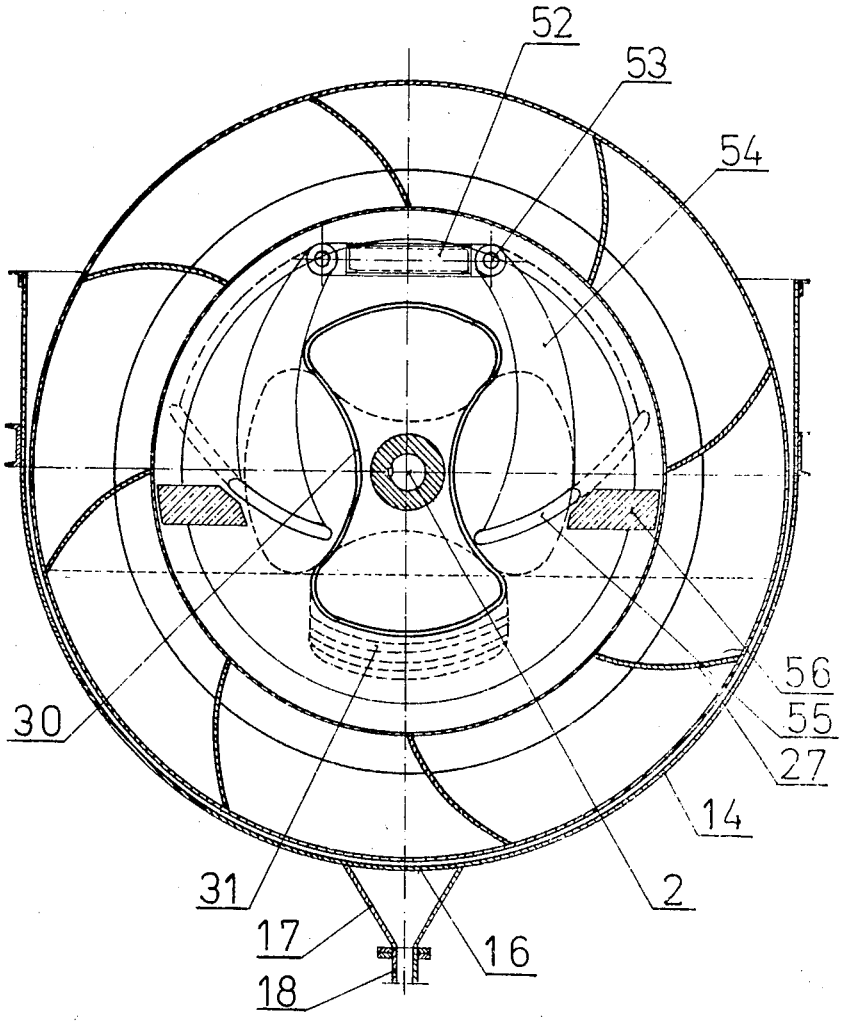
Figure 4:
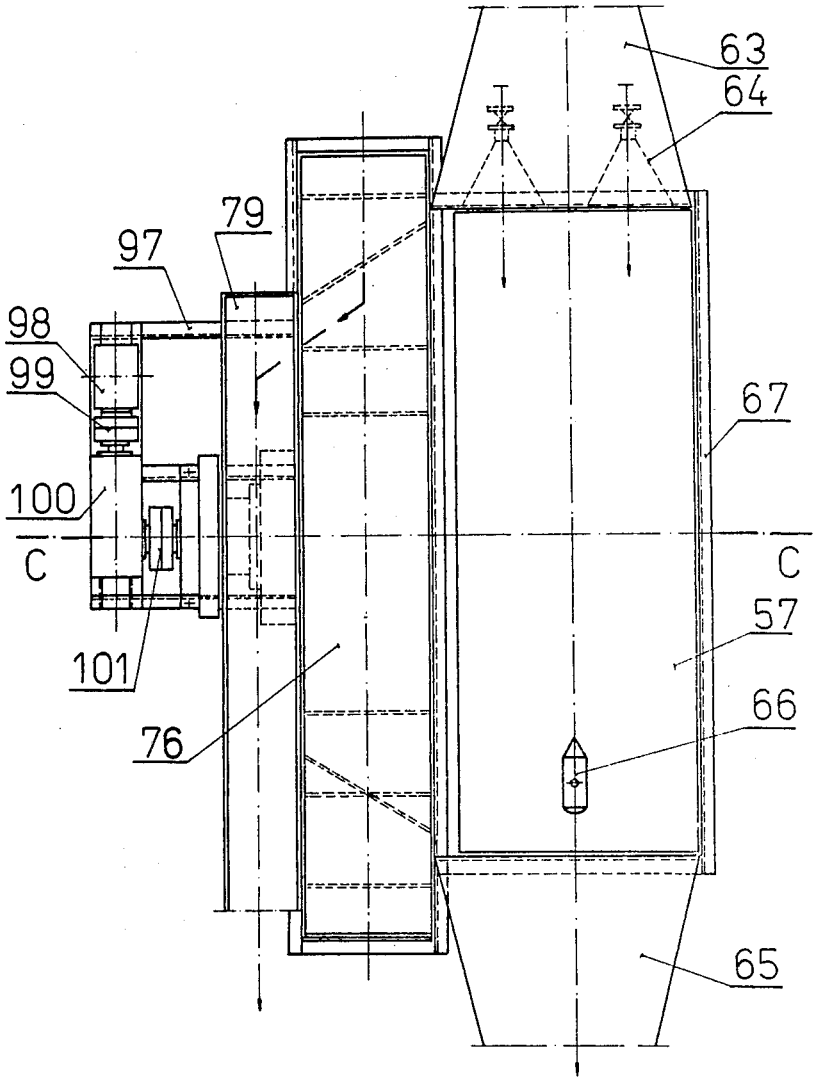
Figure 5:
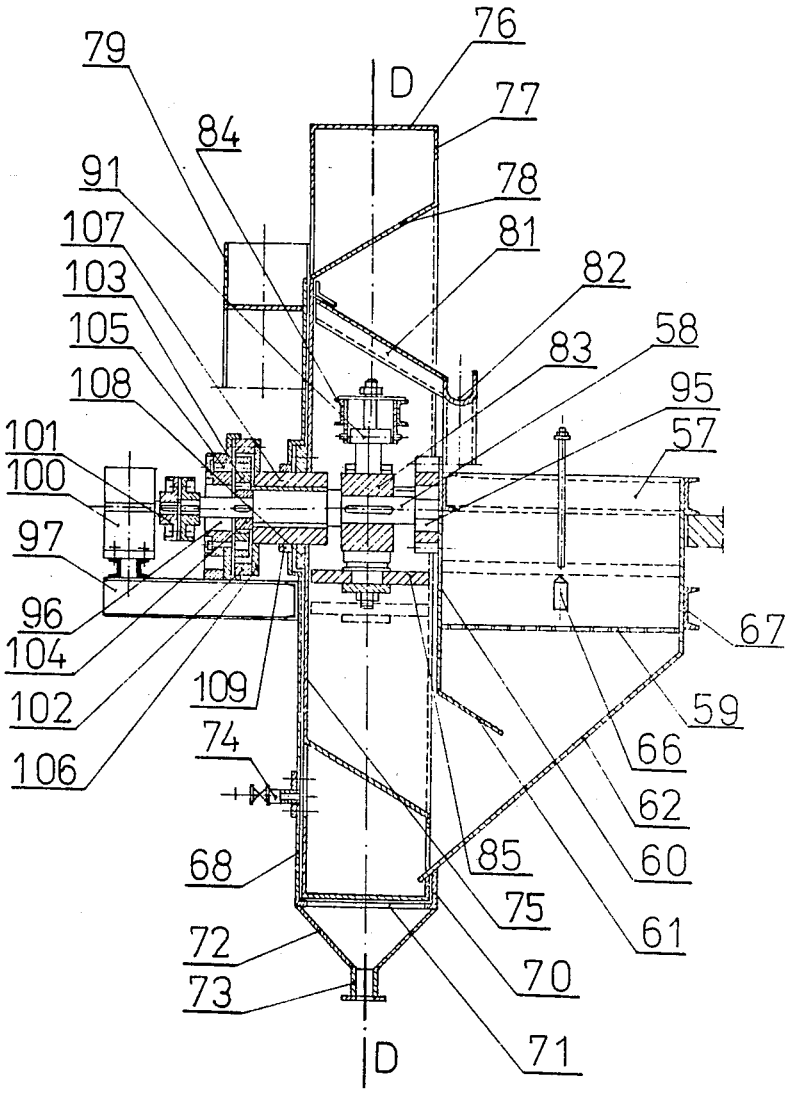
Figure 6:
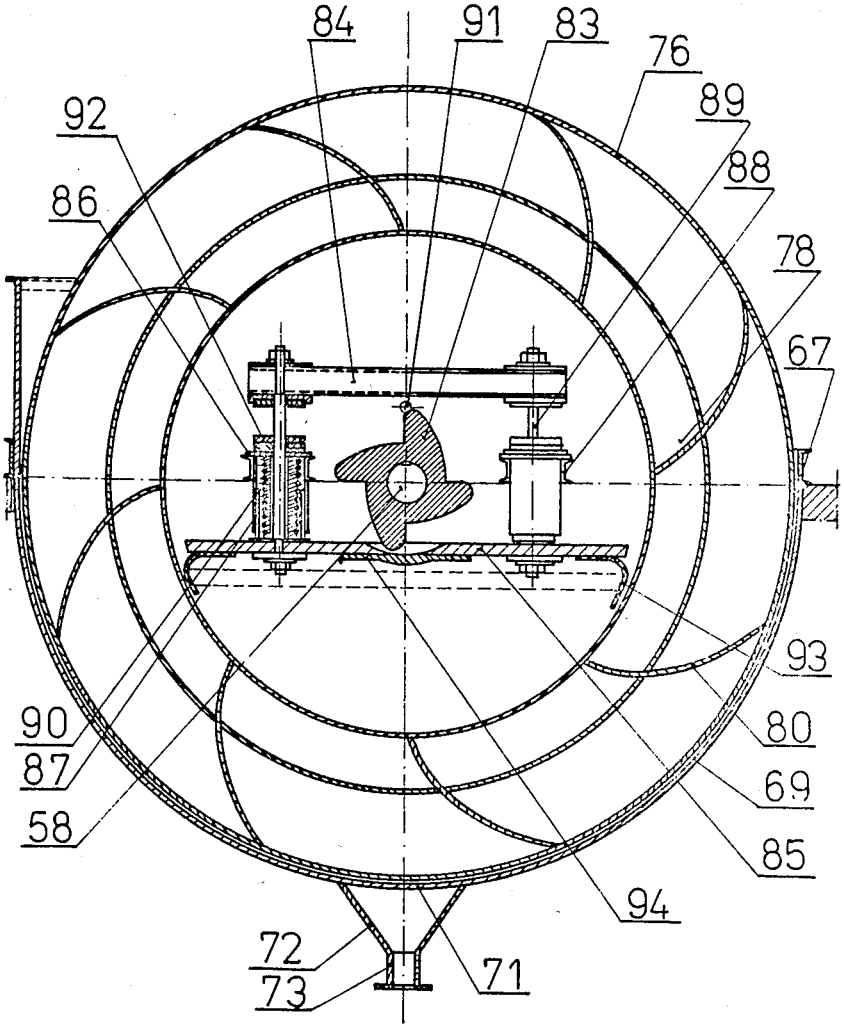

The subject of this present invention is embodied in the drawing where FIG. 1 schematically shows a top view of a pulsator complete with a displacer for enriching hard coal, FIG. 2 shows a vertical cross section of a pulsator complete with a displacer for enriching hard coal along line A—A as shown in FIG. 1, FIG. 3 shows a vertical section of the pulsator complete with a displacer for enriching hard coal through the axis of the hoisting wheel along line B—B shown in FIG. 2, FIG. 4 shows a top view of the pulsator complete with a plate ratchet unit for enriching hard coal, FIG. 5 shows a vertical section of the pulsator complete with a plate ratchet unit for enriching hard coal along line C—C shown in FIG. 4, and FIG. 6 shows a vertical section of the pulsator complete with a plate ratchet unit for enriching hard coal trough the longitudinal axis of the hoisting wheel along line D—D shown in FIG. 5.

Example I

The pulsator for enriching hard coal in a liquid medium, as shown in FIGS. 1, 2 and 3, consists of working trough 1, wherein the enriching process takes place, connected along the longer side to a chamber of cylindrical shape in the longitudinal vertical section, in which a hoisting wheel runs in a liquid and is mounted on drive shaft 2.

Working trough 1 has the shape of a rectangle in a horizontal section and is divided into a lower and upper part by screen deck 3, the upper part being separated from the hoisting wheel with wall 4 reinforced at its upper part with a shaped iron and the lower part of the working trough 1 being truncated towards the hoisting wheel and defined with skew wall 5 and provided inside from the side of the hoisting wheel with guide vanes 6 for liquid motion. Working trough 1 is provided from one side on the shorter side with chute 7 of useful mineral and under the latter there are installed water nozzles 8. The pipe on which water nozzle 8 is installed is provided with valve 9.

The opposite side of chute 7 mounts on the shorter side of working trough 1 chute 10 for receiving the enriched useful mineral. Working trough 1 is provided with float 11 used for regulating the thickness of the layer of heavy products on screen deck 3. In working trough 1 behind float 11 there is mounted a movable baffle not shown in the drawing but directly controlling the thickness of the layer of the sinking product and feeds it under screen deck 3 onto skew wall 5 wherefrom it is directed to the hoisting wheel.

The walls of working trough 1 are supported by supporting structure 12 consisting of shaped irons. The chamber of the hoisting wheel, being also a pulsation chamber, consists of external wall 13 to which is welded bottom wall 14 of arcuate shape and at the other side it is connected to vertical wall 15 connected to skew wall 5 of working trough 1. Bottom wall 14 is provided at its lowest point with grate 16 enclosed with pulp outlet stub pipe 17 provided at its lower part with a flange connected to the flange of drain pipe 18. The lower part of external wall 13 there is installed stub pipe 19 for draining bottom water with valve 20 mounted upstream of it.

The hoisting wheel consists of side wall 21 connected with external screen 22 on the other hand connected in turn to external ring 23 on the periphery of screen 22, located from the side of working trough 1.

Inside the hoisting wheel perforated crown 24 is installed at an acute angle and connected from the top over side wall 13 of the chamber to discharge chute 25 in the form of a trough provide with bottom plate 26 removing the sinking product from the hoisting wheel.

Perforated crown 24 has attached to it paddle buckets 27 and is used mainly for hoisting the sinking product and removing water from it and, additionally, acts as guide vanes for guiding liquid stream under screen deck 3 of working trough 1 and, together with paddle buckets 27 for the sinking product, is made from abrasion-resistant plate.

Hud 28 keyed to drive shaft 2 inside the hoisting wheel mounts a displacer consisting of tow plungers and made up from two side plates 29 connected with external circumferential plate 30. Cover plates 31 can be added to or substracted from the upper and lower part of circumferential plate 30 for changing the volume of the displacer plunger, the displacer having a shape of a closed glass in the vertical section.

Drive shaft 2 runs in rolling bearings 32 and 33 installed above the liquid level of working trough 1, the housing of rolling bearing 32 being supported with support structure 34 consisting of shaped irons and housing 35 for rolling bearing 33 being suspended to support beam 36 located close to wall 4 of working trough 1. Shaft 2 is driven by electric motor 37, coupling 38, transmission gear 39 and in turn coupling 40 and a planetary gearing which consists of internally-toothed gear 42

Satellite gears 43 are mounted on shafts 45 disposed in housing 41 of the planetary gearing. Gear 42 is permanently connected to flange /disc/ 46 welded to hub 47 mounted on bush 48 mounted in turn on drive shaft 2. Hub 47 is connected with its other end to drive ring 49 of the hoisting wheel disjunctly bolted to side wall 21 of the hoisting wheel. Drive ring 49 is separated with offset part 50 of external wall 13 terminating in labyring seal 51 preventing liquid leak to the outside of the chamber of the hoisting wheel.

The gear ratio of the planetary grearing is checked each time the enricher is selected and is adapted to the maximum amount of the sinking product of the useful mineral being enriched.

It is also possible to use a plain spur gearing for driving drive shaft 2 and the hoisting wheel, but the drive of the unit is then to be shifted relative to the transversal axis by a magnitude resulting from the gear centre distance.

Between the displacer and perforated crown 24 of the hoisting wheel there is mounted bearing structure 57 in the form of a cee iron connected to support beam 36 provided at both ends in pins 53 mounting pendula 54 made from plate and connected at the lower part with welded plate 55 cooperating with block 56 restricting liquid flow up the hoisting wheel.

The pulsator for enriching hard coal in a liquid medium can also be built as a two-trough unit depending on needs and output.

The enrichment of hard coal in a liquid medium by means of the pulsator as per this present invention involves uniformly feeding the material to be enriched by means of a vibratory or other feeder to chute 7 wherefrom it passes to working trough 1 filled with liquid, wherein it is subjected to an enrichement process. The material is transported in working trough 1 means of an upper liquid supplied to working trough 1 with nozzles 8. The amount of the required liquid is regulated with valve 9.

A concentrate of the enriched material transported in liquid in an upper layer in working trough 1 is fed from working trough 1 to chute 10 and, therefrom, to water removing devices. On the other hand, the product sinking in the liquid is directed by means of a baffle not shown in the drawing under screen deck 3 against skew wall 5 wherefrom it slides down under gravity to the chamber of the hoisting wheel, wherefrom it is hoisted with paddle buckets 27 on perforated crown 24 upwards and fed to discharge chute 25, used to feed it to water removing devices.

The sinking product is partially freed from water also on perforated crown 24 of the hoisting wheel. After water has been removed from the overgrowths of the worked material hoisted with the hoisting well, they are crushed and again enriched for the purpose of recovering the rest of hard coal. If the hoisting wheel hoists waste /stone/ it is fed to a waste bin wherefrom it is loaded onto means of transport and transported to a dump.

The hard coal enriching process takes place as a result of water pulsation caused by means of electric motor 37. The motor torque is transmitted by coupling 38 to transmission gear 39 and coupling 40 to drive shaft 2, to which is keyed a double bracket. When drive shaft 2 rotates the displacer is immersed in a liquid, which causes its displacement equal to the volume of the bracket immersed in it. During one revolution of drive shaft 2 the plunger is twice immersed, thus causing two pulses to be generated.

The displacer volume determines water amplitude, Sr, of working trough 1. The magnitude of the amplitude can be adapted to the needs of the hard coal being enriched by way of experiments during the commissioning of the pulsator. The volume of the displacer plunger is adjusted with cover plates 31 which are added or removed during the commissioning.

The speed of drive shaft 2 is adapted to the number of pulsations required for enriching the washed material and can be infinitely varied during the operation of the device within the limits of 40–100 cycles/min., the variation being achieved by changing the speed of electric motor 37 or a hydraulic motor, if need be, which can also be used for driving the device.

The speed of the hoisting wheel is lower than that of drive shaft 2 since a planetary gearing has been applied, connected to hub 47 which in turn is connected with drive ring 49 of the hoisting wheel. The latter hoists the sinking product at a speed of 1–8 m/sec. When drive shaft 2 rotates the displacer plungers are alternately immersed, which causes the liquid level of working trough 1 to be raised by quantity Sr and, thus, the enriched material to be crushed and waste to be separated from the concentrate.

Heavier grains drop under the influence of pulsation to screem deck 3 in working trough 1, whereas lighter grains flow together with the upper liquid in working trough 1 and are discharged by means of chute 10. The heavier grains which drop to the bottom of the unit are gathered in a layer on screen 3. The thickness of the layer of the heavier product is adjusted with float 11 which by means of a linkage acts upon a hydraulic servomotor which opens or closes the outlet gap of the heavy product under screen deck 3.

By falling down in the liquid the heavy product encounters skew wall 5 and slides down it towards the hoisting trough. The inflow of water to working trough 1 takes place by means of stup pipe 19 and is quantitatively adjusted with valve 20.

The pulsator, complete with a displacer, is particularly intended for enriching coal dust with a granulation up to 50 mm and other useful minerals.

EXAMPLE II

The pulsator for enriching hard coal in a liquid medium is shown in FIGS. 4, 5 and 6 and consists of working trough 57 wherein the enrichment process takes place and which is connected along its longer side to a chamber having the cylindrical shape in the vertical longitudinal section and accommodating a hoisting wheel mounted on drive shaft 58. Working trough 57 has the shape of a rectangle in the horizontal section and is divided into a lower and an upper part with screen deck 59.

Working trough 57 separated from the chamber of the hoisting wheel with wall 60, reinforced with a shaped iron, wall 60 passing at the lower part under screen deck 59 into guide vanes 61 for directing the liquid which passes under screen deck 59, whereas the lower part of the working trough is skewed to the level and defined with inclined wall 62. Working trough 57 is provided with chute 63 of the worked material at its shorter side with water nozzles 64 mounted under that chute. On the opposite shorter side of working through 57 there is mounted chute 65 for receiving the concentrate of the useful mineral.

Working trough 57 is provided with float 66 used for adjusting the thickness of the layer of heavy products on screen deck 59, a movable baffle not shown in the drawing being mounted behing float 66 to directly regulate the thickness of the layer of the sinking product and feeds it under screen deck 59 to inclined wall 62, whereon it gets to the hoisting wheel. The vertical walls of working trough 57 are supported by supporting structure 67 consisting of shaped irons.

The chamber of the hoisting wheel, simultaneously constituting a pulsation chamber, consists of external wall 68 to which is welded bottom wall 69 of arcuate shape and which is connected at the other side with vertical wall 70 connected in turn to inclined wall 62 of working trough 57. Bottom wall 69 is provided at its lowest point with grate 71 enclosed with pulp outlet stub pipe 72 provided at its bottom part with a flange connected to discharge pipe 73.

In the lower part of external wall 68 there is mounted over pulp outlet stub pipe 72 stub pipe 74 for guiding the lower water with a valve mounted upstream of it.

The hoisting wheel is built up from side wall 75 connected with external screen 76 which is connected at the other side with external ring 77 located from the side of working trough 57. Inside the hoisting wheel there are installed guide vanes at an acute angle to the level and made from performated plate or gap screen and connected over side wall 68 of the chamber to discharge chute 79 in the form of a trough installed along external wall 68.

Guide vanes 78 and side wall 75 have secured thereto paddle buckets 80. At the upper part under guide vanes 78, hood 81 is mounted for draining the liquid removed on the hoisting wheel and connected to trough 82 which is connected to pipes not shown in the drawing.

To drive shaft 58 inside the hoisting wheel is keyed ratchet wheel 83 having four can teeth. Above ractchet wheel 83 inside the hoisting wheel there is mounted frame 84 and, under ratchet wheel 83, plate 85. Frame 84 and plate 85 are mounted on housing 86 of telescope 87 mounted on structure 88 supported by main supporting structure 67 of the pulsator, frame 84 and plate 85 being disjunctly connected with end-thereaded rods 89 whereas springs 90 are installed inside telescope 87 below housing 86.

Frame 84 is provided in line with ratchet wheel 83 with rotary roller 91. Between the frame 84 and housing 85 are installed rubber discs 92 on bar 89 for establishing the necessary liquid pulsation difference. From bottom and around bar 89, plate 85 is provided with rubber stops. On its sides, plate 85 is provided with sealing skirts 93 and, under ratchet wheel 83, with rubber plate seal 94. Drive shaft 58 runs in rolling bearings 95 and 96. The housing of rolling bearing 95 is mounted outside of wall 60 of working trough 57 to supporting structure 67 and the housing of rolling bearing 96 is supported with bearing structure 97. Shaft 58 is driven by a electric motor 98, coupling 99, transmission gear 100 and, in turn, coupling 101 and a planetary gearing. The housing of the planetary gearing is connected to the housing of rolling bearing 96, the planetary gearing itself consisting of internally-toothed gear 102, satellite gears 103 and gear 104 keyed to drive shaft 58.

Satellite gears 103 are mounted on shaft 105 accommodated in the planetary gearing housing. Gear 102 is permanently connected to flange 106 welded to hub 107 mounted on a bush mounted in turn on drive shaft 58. Hub 107 is connected with its other end to drive ring 108 of the hoisting wheel disjunctly bolted to side wall 75 of the hoisting wheel. Drive ring 108 is separated with an offset wall component of external wall 68 terminating in labyrinth seal 109 preventing liquid leakage to the outside of the chamber of the hoisting wheel.

A plain spur gearing cam be used instead of the planetary gearing for driving the hoisting wheel, the driving set being then different, but the unit will operate in the same way. The pulsator for enriching hard coal be also built as two-trough depending on needs and outputs. The enrichment of hard coal in an aqueous medium by means of the pulsator as per this present invention involves feeding the material to be enriched to chute 63 of working trough 57. The material is fed uniformly over the entire width of working trough 57 by means of vibrating feeders, or another feeder mounted in front of chute 63. The working material is transported in working trough 57 by means of liquid supplied with nozzles 64 provided with manually or mechanically remotely adjustable regulators and located at appropriate valves.

The enriched concentrate is transported in the upper layer in working trough 57 and is fed to chute 65 and, therefrom to water removal plant. The product sinking in the liquid is directed by gravity by means of a baffle not shown in the drawing under screen deck 59 to skew wall 62 of working trough 57 and slides down it to the internal side of external screen 76 of the hoisting wheel and is hoisted with paddle buckets 80 out of the liquid upwards and, once the hoisting wheel has rotated through 180°, it drops down to guide vanes 78.

The sinking product passes from guide vanes 78 through a hole in side wall 75 to the outside of the hoisting wheel to chute 79 to the left of the hoisting wheel. Chute 79 directs it to be crushed if it is an intermediate product /overgrowth/ and, after that operation, it is directed again for enrichment for the purpose of removing the rest of the useful mineral. Waste /stone/ is directed to waste bins or, directly, to units transporting it to further utilization or to a dump.

The process of enriching hard coal takes place due to water pulsation which occurs when drive shaft 58 rotates together with ratchet wheel 83 keyed to it. Drive shaft 58 rotates the hoisting wheel via the satellite gearing, hub 107 and 108. For causing the pulsation of the liquid and hoisting the sinking product, use is made of one drive. Drive shaft 58 directly drives ratchet wheel 83 which causes the liquid to pulsate. When rotating, ratchet wheel 83 causes springs 90 mounted in telescope 87 together with plate 85 to be tensioned with its cam teeth via rotary roller 91 and steel frame 84. After reaching the maximum upper position and further rotation of drive shaft 58 roller 91 is meshed out and plate 85 together with frame 84 fall down due to springs 90 being freed from tension, In falling down, plate 85 strikes against the liquid level and transmits the energy contained in springs 90 and the liquid lift necessary for enrichment by the weight of the entire set of frame 85 and plate 84. The motion of the liquid which is raised or quantity h loosens the enriched material in working trough 57 and thus causes the hard coal concentrate to be separated from waste.

The magnitude of that liquid lift, i.e. the height of rising the liquid is adjusted with rubber discs 92 which are used for establising the liquid pulsation difference required for the enrichment. The liquid pulsation frequency is adjusted with the speed of drive shaft 58. With four-tooth ratchet wheel 83 four pulsations are obtained per one revolution of drive shaft 58. Ratchet wheel 83 can have 2–5 teeth whereupon speed of drive shaft 58 should be synchronized in proportion to the tooth number. The pressure of plate 85 against the liquid level causes its flow under screen deck 59 of working trough 57 and every rise in the liquid level causes the separation of the material being enriched. The direction of flow under screen deck 59 is imported to the liquid stream by guide vanes 78 of the hoisting wheel and guide vanes 61 of working trough 57. The liquid flows without loss over plate 85 since the flow under screen deck 59 is ensured by sealing skirts 93 and seal 94 under ratchet wheel 83.

Water flows from guide vanes 78 at the upper position to hood 81 and is discharged with trough 82 and pipes to a closed water circulation system of the enrichment process and, particularly, to the pipe line of the water intended for clasification. The loss of the bottom liquid due to its being hoisted together with the concentrate and waste on guide vanes 78 of the hoisting wheel is compensated for by means of stub pipe 74 and a valve installed for regulating the volume of the water supplied.

The speed of drive shaft 58 is adapted to the required number of pulsations amounting to 40–80 cycles/min. for hard coal. Over that range is adjusted the speed of electric motor 98. The speed of the hoisting wheel is lower then that of drive shaft 58 and, consequently, an intermediate planetary gear ratio has used for its speed and the hoisting wheel itself has been rotatably mounted on drive shaft 58.

The speed of the hoisting wheel is dependent upon the volume of the product sinking in liquid during enrichment and, consequently, the speed of the hoisting wheel and, thus, the planetary geer ratio is every time matched to a given worked material. The speed of hoisting is adjusted within 1–6 m/sec. with the speed of the hoisting wheel. The pulp accumulating between the hoisting wheel and the chamber is removed by means of outlet stub pipe 72 to discharge pipe 73. The pulp accumulated under the hoisting wheel is periodically cleaned.

The pulsator, complete with the plate ratchet unit, is intended for enriching hard coal sizes up to 180 mm and, even more, and other useful minerals.

We claim:

1. A pulsator for enriching, particularly, hard coal, comprising a working trough, a screen deck dividing said working trough into an upper part and a lower part, a first chute at one side of said trough for useful mineral, a second chute at another side of said trough for receiving enriched useful mineral, a float in said trough for regulating the thickness of a layer of heavy products on the screen deck, a cylindrical pulsation compartment connected to said trough and separated from said trough by a wall, a hoisting wheel disposed in said pulsation compartment, a drive shaft for said hoisting wheel, bearing for said drive shaft disposed above a liquid level in said working trough, and a displaced comprising a bracket mounted on said drive shaft and disposed in said pulsation compartment.

2. A pulsator according to claim 1, wherein said pulsation compartment comprises an external wall, an arcuate bottom wall welded at one side thereof to said external wall, said trough having a skew wall, said bottm wall being connected at another side thereof via a vertical wall to said skew wall, and there is a grate provided at the lowest point of said bottom wall, said grate being enclosed with a pulp outlet stub pipe connected to a discharge pipe.

3. A pulsator according to claim 2, wherein in the lower part of said external wall there is provided a stub pipe for discharging bottom water and a valve disposed upstream of said stub pipe.

4. A pulsator according to claim 2, wherein said hoisting wheel comprises a side wall, an external screen connected at one side thereof to said side wall, an external ring connected at another side of said external screen along the periphery of said external screen, and there is a perforated crown inside said hoisting wheel disposed at an acute angle from the top thereof over said external wall of said pulsation compartment, which crown is connected to a discharge chute in the form of a trough provided with a bottom plate, and paddle buckets attached to said perforated crown.

5. A pulsator according to claim anyone of claims 1 to 4, wherein a hub is keyed to said drive shaft, said bracket being mounted on said hub inside said hoisting wheel and comprising two plungers having a shape of a closed hourglass in vertical section built up from two side plates interconnected with an external circumferential plate, and there are provided cover plates which can be added to or removed from upper and lower parts of said circumferential plate.

6. A pulsator according to claim 4, wherein a drive for said hoisting wheel comprises an electric motor, a coupling to a transmission gear, a successive coupling to a planetary gearing consisting of an internally-toothed gear, satellite gears and a further gear keyed to said drive shaft, said satellite gears being mounted on shafts placed in a planetary gearing housing and said internally-toothed gear being permanently connected to a flanged welded to one end of a mounted on a bush which is mounted in turn on said drive shaft, said hub being connected at another end thereof to a drive ring disjunctly connected to said side wall of said hoisting wheel.

7. A pulsator according to claim 6, wherein said drive ring is separated with an offset component of said external wall of said pulsation compartment terminating in a labyrinth seal.

8. A pulsator according to claim 4, wherein there is a bearing structure mounted between said displacer and said perforated crown of said hoisting wheel, said bearing structure being connected to a support beam and being provided with pins at both ends thereof, said pins mounting pendula which are provided at the lower part thereof with horizontally disposed plates which cooperate with blocks restricting the flow of liquid upwards of said hoisting wheel.

9. A pulsator for enriching, particularly, hard coal, comprising a working trough, a screen deck dividing said working trough into an upper part and a lower part a first chute at side of said trough for useful mineral, a second chute at another side of said trough for receiving enriched useful mineral, a float in said trough for regulating the tickness of a layer of heavy products on the screen deck, a cylindrical pulsator compartment connected to said trough and separated from said trough by a wall, a hoisting wheel disposed in said pulsation compartment, a drive shaft for said hoisting wheel, bearings for said drive shaft disposed above a liquid level in said pulsator compartment and working trough, a housing for said bearings secured to a supporting structure and a bearing structure, and a ratchet wheel mounted on said drive shaft and disposed in said pulsation compartment.

10. A pulsator according to claim 9, wherein said pulsation compartment comprises an external wall, an arcuate bottom wall secured at one side thereof to said external wall, said trough having an inclined wall, said bottom wall being connected at another side thereof to a vertical wall wich is connected to said inclined wall, and there is a grate provided at the lowest point of said bottom wall, said grate being enclosed with a pulp outlet stub pipe connected to a discharge pipe.

11. A pulsator according to claim 10 wherein at the lower part of said external wall there is provided a stub pipe for supplying lower water, said stub pipe being over said pulp outlet stub pipe, and there is a valve mounted upstream of said stub pipe.

12. A pulsator according to claim 10 wherein said hoisting wheel comprises a side wall, an external screen connected at one side thereof to said side wall, an external ring connected at another side of said external screen, said external ring being located at the side of said working trough, and there are guide vanes inside said hoisting wheel at an acute angle to the horizontal, said guide vanes being connected above said external wall of said pulsation compartment to a discharge chute in the form of a trough located along said external wall of said pulsation chamber, and paddle buckets secured to said guide vanes and side wall of said hoisting wheel.

13. A pulsator according to claim 12, wherein a hood is mounted under said guide vanes at the upper part of said hoisting wheel for removing liquid from the sinking product from which water was removed on the hoisting wheel, said hood being connected to a further trough.

14. A pulsator according to claim 12, wherein a drive for said hoisting wheel comprises an electric motor, a coupling to a transmission gear, a successive coupling to a planetary gearing consisting of an internally-toothed gear, satellite gears and a further gear keyed to said drive shaft, said satellite gears being mounted on shafts disposed in a planetary gearing housing and said internally-toothed gear being permanently connected to a flange permanently connected to one end of a hub mounted on a bush which is mounted in turn on said drive shaft, said hub being connected at another end thereof to a drive ring of said hoisting ring disjunctly connected to said side wall of said hoisting wheel.

15. A pulsator according to claim 14, wherein said drive ring is separated with an offset component of said external wall of said pulsation compartment terminating in a labyrinth seal.

16. A pulsator according to claim 9, wherein said ratchet wheel has at least two cam teeth and is keyed to said drive shaft inside said hoisting wheel, and there is a frame above said ratchet wheel and a plate under said ratchet wheel, both said frame and said plate being mounted on a housing of a telescope which is secured on a structure supported on said supporting structure, and said frame and plate being interconnected with end-threaded rods, and there are springs accommodated inside said telescope below said housing of said telescope.

17. A pulsator according to claim 16, wherein said frame is provided in line with said ratchet wheel with a rotary roller, and rubber discs are mounted on a bar between sad frame and said housing for said telescope for establishing the required liquid pulsation difference.

18. A pulsator according to claim 16 or 17 wherein said plate is provided at its sides with sealing skirts and a rubber plate seal under said ratchet wheel.

* * * * *